United States Patent [19]

Jones

[11] Patent Number: 4,852,313

[45] Date of Patent: Aug. 1, 1989

[54] BUILDING ARRANGEMENT AND METHOD FOR VIEW SITE

[76] Inventor: Robert E. Jones, P.O. Box 1128, La Jolla, Calif. 92038

[21] Appl. No.: 759,357

[22] Filed: Jul. 26, 1985

[51] Int. Cl.[4] ..... E02D 1/92

[52] U.S. Cl. ..... 52/169.3; 52/169.4

[58] Field of Search ..... 52/169.3, 169.2, 169.4

[56] References Cited

U.S. PATENT DOCUMENTS 4,575,977 3/1986 Taylor ..... 52/169.3

FOREIGN PATENT DOCUMENTS 2465046 4/1981 France ..... 52/169.2

1014595 12/1965 United Kingdom ..... 52/169.3

OTHER PUBLICATIONS

Carousel Development Corporation, copy 169.3.

*Primary Examiner*—Carl D. Friedman

*Assistant Examiner*—Creighton Smith

*Attorney, Agent, or Firm*—Fulwider, Patton, Lee & Utecht

[57] ABSTRACT

A housing arrangement and method for maximizing the number of houses with a line of sight to a view. The arrangement comprises a plurality of lots arranged side-by-side adjacent a view and along an imaginary arcuate string line which is connectable to other such string lines along an undulating path to define successive peaks closer to the view and valleys farther from the view. All lots thereby have a line of sight to the view. The lots are preferably each characterized by a building perimeter layout or envelope of predetermined configuration and orientation to enable substantially identical buildings to be placed on all of the lots.

15 Claims, 3 Drawing Sheets

BUILDING ARRANGEMENT AND METHOD FOR VIEW SITE

BACKGROUND OF THE INVENTION

1. Field of the Invention

The present invention relates to a building arrangement and methods to maximize the number of houses with a line of sight to a view, and more particularly to such an arrangement and method in which the lots are arranged along string lines connectable to define an undulating path.

2. Description of the Prior Art

An important economic goal in locating buildings or homes adjacent an attractive view is to maximize the number of houses which have visual and physical access to that view. View lots command a premium price in the housing market and a prudent developer takes every advantage of topography to provide some kind of view for every house in the development. If the view site is a lake, for example, and the surrounding land is generally flat, the developer typically arranges the view or premium lots side by side around the lake perimeter. Houses in the second row have virtually no view, except what might be available by offsetting the houses in the second row so that a view is available through the side yards of the front row of houses. Even this possibility is not available where the first row of houses are built close together without any appreciable side yard spaces, or where walls are built which obstruct the view of the second row. Obviously, physical access is also not available to any but the front row of houses.

As a consequence of this prior art housing arrangement, only the houses in the perimeter or first row command premium prices and the developer must settle for much lower prices on lots not in the perimeter row.

Although reference has been made to a lake as the view of interest, the same dilemma faces developers of lots adjacent any "view", which could be any open space or "green belt", a golf course, a mountain range, river, etc. The increasingly high price of land renders this problem of better utilization of view property even more acute.

Compounding the problem of maximizing the number of view lots is the complexity of laying out such lots over uneven terrain, making them generally uniform in size and configuration so that identical house plans can be used for economy of construction, and arranging the lots such that there is ease of access to streets and utilities. Non-uniform lot configurations and boundaries usually require custom made, one of a kind house plans unsuited to computerized planning.

SUMMARY OF THE INVENTION

According to the present invention, a housing arrangement and method is provided which maximizes the number of houses with a line of sight to a view. The housing arrangement comprises a plurality of side-by-side lots arranged along an imaginary string line connectable to other string lines in a serpentine or undulating path to multiply the number of lots having a line of sight to the view. The reversals of curvature in such an undulating string line define successive peaks and valleys. The radius of curvature of the string line in each peak and valley is preferably made constant, with the string line arranged to pass through the middle of each lot. As a consequence, the lots for each individual peak or valley can be made uniform in size and configuration.

They can be reversed or "flipped" in orientation at each reversal of curvature of the string line.

The uniformity of the lots enables a standard or predetermined building boundary or envelope to be established which will fit on the smallest lot, and within which a "standard" house can be constructed for all of the lots. The configuration of the predetermined building envelope is preferably selected such that it can be reversed or "flipped" on any lot to capitalize on the available view or to take advantage of any particular feature of the topography.

In one embodiment each building envelope is pentagonal in shape with four of its sides generally parallel to the four lot lines. One of these four sides is also coincident with one of the side property lines. The envelope is spaced from the other of the side property lines to provide for detached or separated houses.

The housing arrangement contemplates omission of houses on certain lots to provide vacant slots or gaps and thereby enable a second or even a third plurality of lots to be arranged along second and third stringlines behind the first string line to provide a line of sight to the view.

DESCRIPTION OF THE PREFERRED EMBODIMENT

Figure 1:
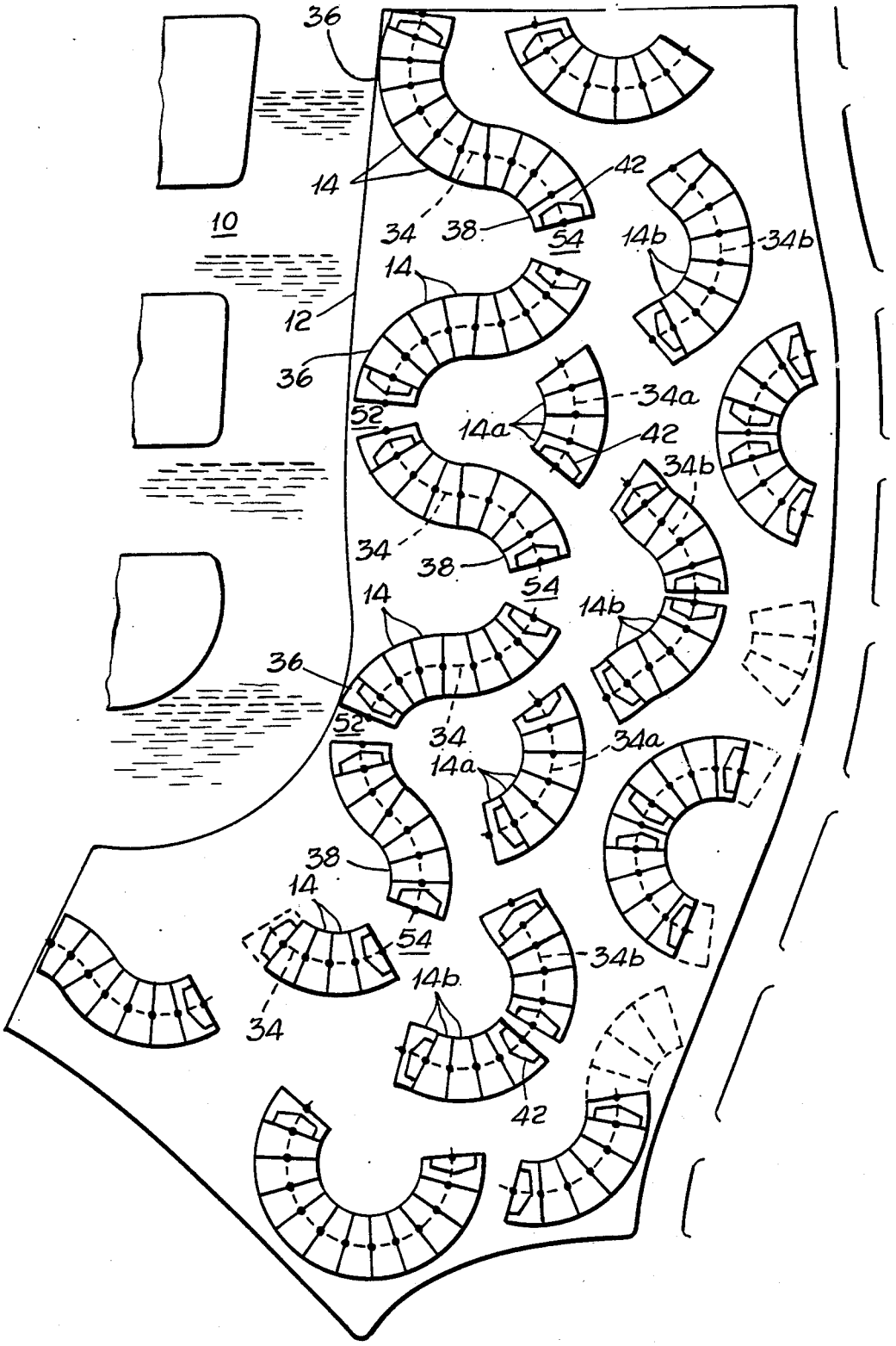
FIG. 1 is a schematic plan view of the present housing arrangement located adjacent a view site.

Referring now to the drawings, a housing arrangement according to the present invention is illustrated adjacent a view site generally designated by the numeral 10. Although the view 10 can be any open space or natural or man-made attraction, in the present application it is a body of water having three islands and a shoreline 12.

In a typical prior art housing arrangement, the lots for the houses would be arranged along the shoreline 12 in side-by-side relation so that the rows of houses other than the front or perimeter row would have no view of the view 10 except through side yard spaces which might be present in the perimeter row.

As will be seen, the housing arrangement of the present invention increases the number of lots oriented to the view 10 by up to two and a half times compared to the number of prior art rectangular lots perpendicularly oriented to the view, while yet maintaining an average lot width the same as the prior art rectangular lot.

Although not illustrated in detail, driveway or street access to the lots of the present housing arrangement would be from the side remote from the view 10 in most instances, but driveway and street access can be arranged in any desired way to provide commonality and uniformity in building layouts.

Although the present disclosure refers to construction of a house or home, it will be understood that these terms are merely exemplary and are intended to comprehend any building or group of buildings, such as a house and a garage, or a duplex, condominium or the like. Further reference to visual access is intended, to comprehend physical access as well, where that is possible.

Figure 2:
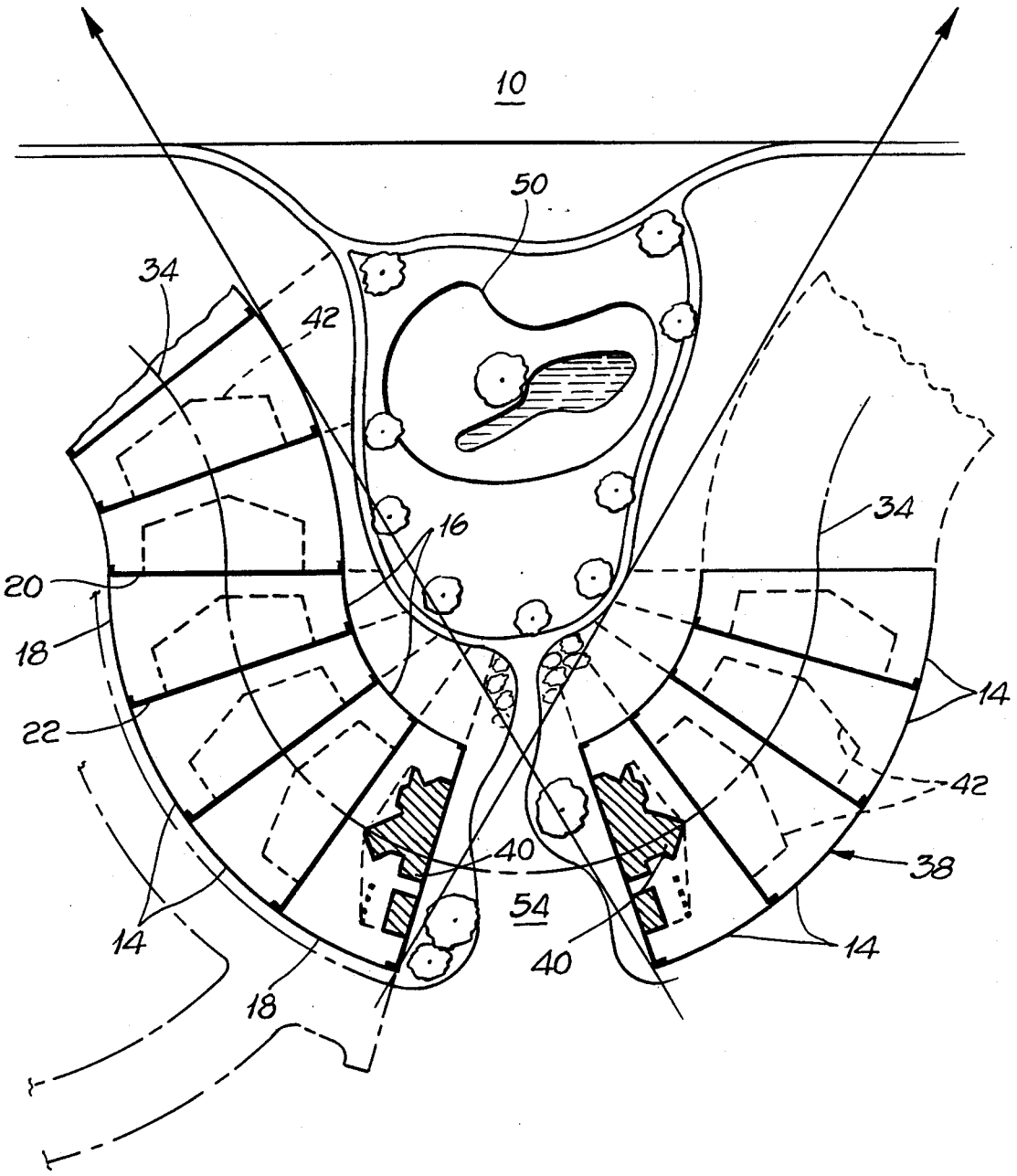
FIG. 2 is an enlarged view of one of the "valleys" of the arrangement of FIG. 1.
Figure 3:
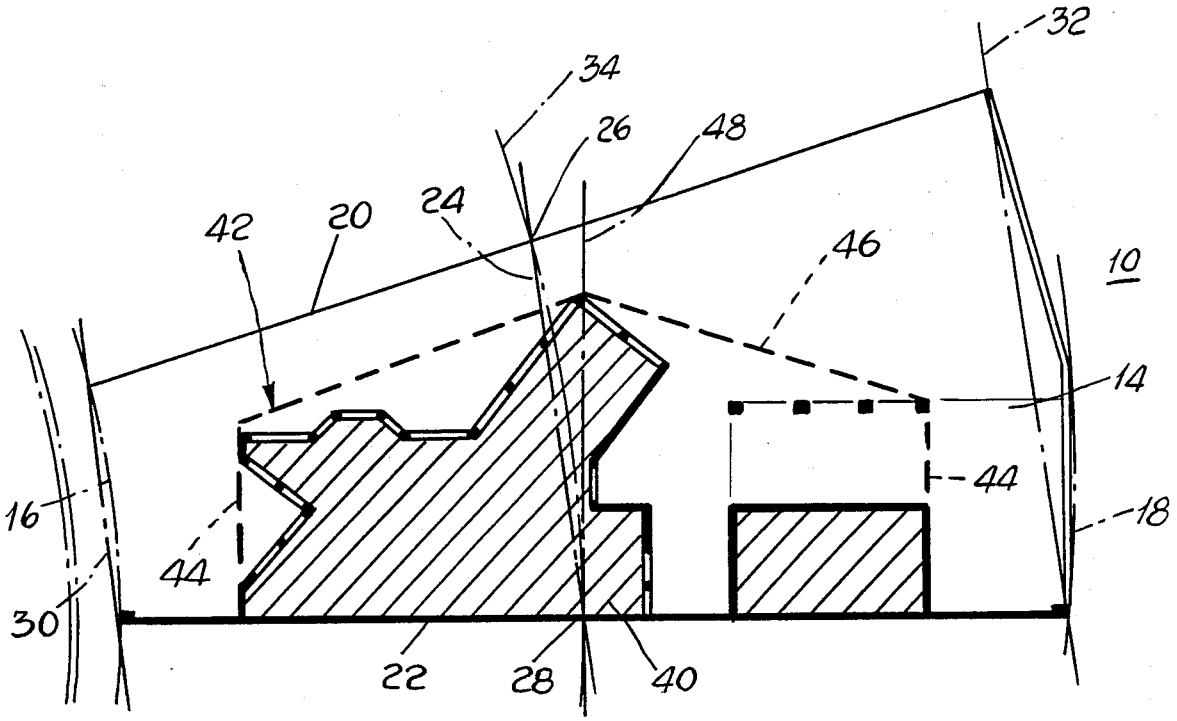
FIG. 3 is an enlarged plan view of one of the lots of FIG. 2.

The present housing arrangement comprises a plurality of lots 14 arranged side-by-side adjacent the view 10. Each of the lots, as best seen in FIG. 2, includes arcuate front and rear property lines 16 and 18, and side property lines 20 and 22, and each pair of adjacent lots 14 is adjoining, having a common side property line.

Figure 4:
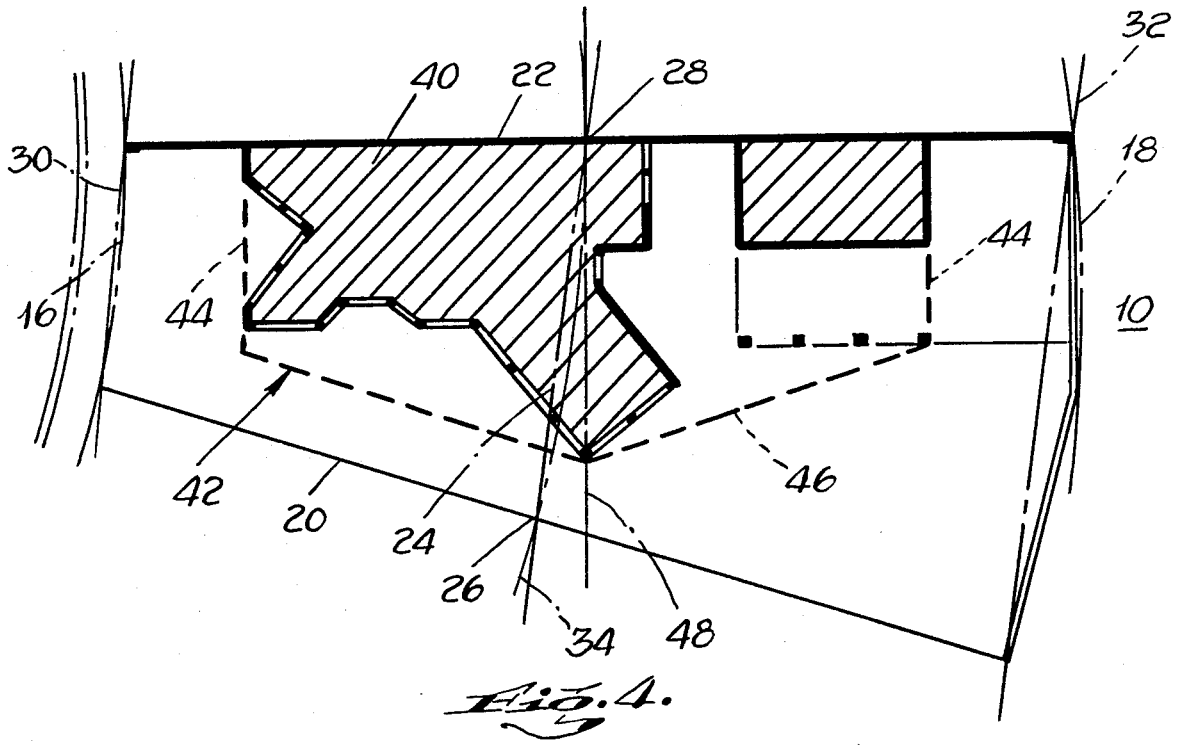
FIG. 4 is a plan view of a lot adjacent the lot of FIG. 3, illustrating how the house plan of the lot of FIG. 3 can be reversed or "flipped" and used for the lot of FIG. 4.

Each lot 14 has an average width through its middle, as measured along an imaginary width line 24, which intersects its side property lines 20 and 22, as seen in FIG. 4. The average width is the average of the narrowest width 30 at the front property line 16 and the widest width 32 at the rear property line 18. The terms "front" and "rear" are used relative to the view 10, and the front property line is less or greater than the rear property line, depending upon the lot orientation toward the view.

The lots 14 are arranged along an imaginary string line 34 which in one embodiment follows reversals of curvature to define a serpentine or undulating path providing successive peaks and valleys 36 and 38, as seen in FIG. 1. The string line 34 runs through the middle of the lots 14, and intersects the side property lines 20 and 22 at the points of intersection 26 and 28 of the side property lines by the width line 24, as best seen in FIG. 4.

The undulating path, in plan view, of the string line 34 locates the lots 14 on the "upside" of each peak 36 in progressively closer relation to the view 10, while the lots on the other or downside of the peak are progressively farther from the view.

The string line method greatly facilitates planning for large housing developments, particularly one located on uneven terrain. For example, if the development is planned for a hill or knoll with irregularly shaped sides, the hill is typically leveled to a predetermined elevation, producing a site having in plan view an undulating perimeter overlooking the view to the lower elevations or canyons.

A continuous string line 34 which will maximize utilization of the view is established by determining the respective centers of the site portions which project toward the view and those which recede from the view. By connecting these centers with an imaginary line, a series of short arcs or string lines 34 may be struck, each of constant but usually different radius, with these arcs being connected to form a continuous undulating string line.

Each of the arcuate areas, that is, the peaks and valleys of the undulations, can next be subdivided into lots which will have the same width for each of the areas, but with the lot width and side boundary angles varying between areas because of the different radii of the respective arcs or string lines.

A plurality of houses 40, as best seen in FIG. 4, can now be located on these lots 14, using an imaginary "standard" building perimeter or envelope 42.

The size and configuration of the envelope 42 is selected such that it will fit within any one of the lots 14 intersected by the string lines 34, whether the lot is the narrowest or the widest, as determined by the radius of curvature of its particular string line section. Once a standard envelope 42 is established, a standard or uniform house can be fitted onto each lot 14 in the development. Thus, the present system lends itself to computerized planning for a whole development.

On flat or uniformly sloping topography the string lines 34 of all peaks and valleys could be made the same in radius, if desired, which would further simplify development planning.

In relatively rugged terrain having knolls and valleys, ridges and ravines, the string line method is a particularly important planning tool. For simplicity, let us assume the string line to be a string of beads. Rather than grading the top of a hill or knoll to provide the development site, as discussed above, the imaginary string of beads can be visualized as laid or draped onto the topography at an elevation as nearly the same as possible throughout its length. The centers of the peaks and valleys of the resulting string are identified, connected by an imaginary line, and utilized to strike a series of arcs, each of constant radius but, as in the first example, differing in radii compared to one another. The lot lines and "standard" building envelope are then established as before.

As will be seen, by using the string line method it is possible to establish a series of lots having almost identical characteristics with respect to grading, view enhancement, drainage and street orientation. The house plans from lot to lot can be made identical, no matter how rugged the terrain.

Once the string line 34 has been established, the front and rear property lines 16 and 18 are established by measuring from the string line. Usually the distances of the lines 16 and 18 from the string line 34 for any one peak or valley will be the same so as to provide lots of uniform depth or size. However, the lot depths could be made greater or longer, if desired, to better adapt the lot to peculiarities of topography. On the other hand, if uniformity of house plans is to be preserved, the lot depth should not be made so shallow that it cannot accommodate the "standard" building envelope. A too shallow lot could require a custom home, or a revised house location and introduce complications respecting street and utility access.

As seen in FIG. 4, one side or base of the building envelope 42 is preferably coincident or common with a side property line 22. This places the house on the lot line with the best access to the view, the building envelope 42 preferably being flipped or reversed so that the house would lie on the opposite lot line when the curvature of the string line reverses. This can be seen in FIG. 2 at the base of the "valley".

The envelope sides 44 and the two sides 46 opposite the envelope base are generally symmetrical about the centerline 48 of the envelope 42. In addition, one of the sides 46 is parallel to the adjacent side property line. Further, all of the building envelopes 42 have the same width along their centerlines 48. This particular configuration of the envelope 42 relative to the boundaries of the associated lot 14 enables the envelope to occupy the same space and orientation irrespective of whether it is flipped one way or the other about the centerline 48 adjacent the string line 34. A builder or developer can therefore utilize a uniform floor plan for all houses 40 if he wishes, and yet have them fit on any lot 14, whether on an inside or an outside radius of the successive peaks and valleys 36 and 38. A "standard" building envelope 42 also enables the developer to quickly and easily lay out street and driveway access.

As best seen in FIG. 1, by arranging the houses 40 along the undulating string line 34 the front or perimeter row of houses 40 all have a line of sight to the view 10. At each change in curvature of the string line 34, the lot configuration is reversed, and the building envelope is also flipped or reversed, as best seen in FIG. 2.

The included areas within the peaks and valleys can be utilized as a green belt, park area, community swimming pool or the like, as generally indicated at 50 in FIG. 2. Also as seen in FIG. 2, the house or houses in the middle of a peak can be omitted to provide a vacant space 52 behind which can be located a second plurality of lots 14*a* along an arcuate string line 34*a* This secondary group of lots 14*a* will have a line of sight to the view 10 through the open space 52.

A tertiary or third plurality of lots 14*b* can also be located behind a gap or space 54 provided in the valleys 38 of the first plurality of lots 14 by omitting one and preferably two houses on these lots, as seen in FIG. 1. The third plurality of lots 14*b* is laid along an arcuate string line 34*b* as illustrated, and some houses in the third plurality of lots 14*b* can also be omitted to provide a view for yet other pluralities of lots behind the third plurality of lots 14*b*, as generally indicated in the schematic showing of FIG. 1.

Additional lots can be provided at the ends of the second or third pluralities of lots to provide an aesthetically pleasing reversal of the curve of the arc, and also to take maximum advantage of the view.

If absolute uniformity in house plans is not critical, the present system can be modified in a number of ways. For example, once the standard building envelope is established, it can be expanded or contracted for certain lots to accept larger or smaller houses and associated structures. Further, where there is an odd shaped piece of property, or some other unique situation, the lot could be moved forward or backward relative to the view access side, which shifts that segment of the string line associated with the lot, to create a lot of greater or lesser width at the original string line location.

With the foregoing arrangement it will be apparent that many more lots in a building arrangement can be provided with a line of sight to a view 10, as compared with the prior art side-by-side, perpendicular perimeter arrangement. Further, by employing the string line method in combination with a standard building envelope of predetermined configuration and location, the builder or developer can construct identical houses on each of the lots, with a predictable, easily laid out pattern of driveways, streets and utilities.

Various modifications and changes may be made with regard to the foregoing detailed description without departing from the spirit of the invention.

I claim:

1. A housing arrangement for maximizing the number of houses with a line of sight to a view site, said housing arrangement comprising:

a plurality of adjoining lots located adjacent the view site and along a string line arranged in an undulating path adjacent the view site and passing through the middle of each of said lots; and a plurality of spaced apart houses on a predetermined number of said lots, respectively, each house lying within a standard building envelope configured and dimensioned to fit within any of said predetermined number of lots, all of said building envelopes being spaced from one of the side boundaries of the lots within which they are located to define visual spaces between adjacent houses, respectively, whereby some portion of each of said houses is on a line-of-sight to the view site and whereby all of said houses may use a single floor plan or a reverse or mirror image of said single floor plan.

2. A housing arrangement according to claim 1 wherein said undulating path defines successive peaks and valleys, and wherein radius of said string line within each of said peaks and valleys is constant but not necessarily the same in radius as others of said peaks and valleys.

3. A housing arrangement according to claim 1 wherein sail building envelope has five sides, four of which are oriented in approximate alignment with the front, rear and side property lines, respectively, of the associated one of said lots whereby said building envelope may be reversed on any of said predetermined number of lots if desired.

4. A housing arrangement according to claim 1 wherein all of said building envelopes are located immediately adjacent corresponding side boundaries of the lots within which they are located.

5. A housing arrangement according to claim 1 wherein said predetermined number of lots are of equal width in the region of said string line.

6. A housing arrangement according to claim 2 and including a second plurality of said adjoining lots arranged along a constant radius second string line located behind one of said peaks; further including a second plurality of houses on said second plurality of said lots, respectively; and wherein at least one of said lots in said one of said peaks is vacant to provide a line-of-sight to the view site for said second plurality of homes.

7. A housing arrangement according to claim 2 and including a third plurality of said adjoining lots arranged along a constant radius third string line located behind one of said valleys; further including a third plurality of houses of said third plurality of said lots, respectively; and wherein at least a pair of said lots in said one of said valleys is vacant to provide a line-of-sight to the view site for said third plurality of houses.

8. A housing arrangement according to claim 6 and including a third plurality of said adjoining lots arranged along a third string line located behind one of said valleys; further including a third plurality of houses on said third plurality of said lots, respectively; and wherein at least a pair of said lots in said one of said valleys is vacant to provide a line-of-sight to the view site for said third plurality of houses.

9. A housing arrangement for maximizing the number of houses with a line-of-sight to a view site, said housing arrangement comprising:

a plurality of lots arranged side-by-side adjacent the view site, each of said lots having front, rear and side property lines, the side property line between each pair of adjacent lots being common to said pair, said lots being arranged along a string line which follows an undulating path through the approximate middle of each of said lots to thereby define successive peaks and valleys; and a plurality of houses on certain of said lots, respectively, each house on a lot lying within a building envelope having a pentagonal form, four sides being oriented in approximate alignment with the four property lines of said lot, said building envelopes on said one side of each of said peaks being located oppositely of the building envelopes on the other side of each of said peaks, said building envelopes being located immediately adjacent corresponding side property lines of said certain lots.

10. A housing arrangement according to claim 9 wherein each of said lots defining a peak is characterized by a front property line longer than its rear property line, and each of said lots defining a valley is characterized by a front property line shorter than its rear property line.

11. A housing arrangement according to claim 6 wherein each of said second plurality of said lots is characterized by a front property line shorter than its rear property line.

12. A housing arrangement according to claim 7 wherein each of said third plurality of said lots is characterized by a front property line shorter than its rear property line.

13. A method of maximizing the numberof houses in a development site with a line-of-sight to a view site, and wherein said development site is on relatively flat topography, said method comprising the steps of:

locating an imaginary string line in an undulating path upon a plan view of the development site whereby said string line defines alternate peaks and valleys adjacent said view site, said string line being configured to have a radius which is constant within each of said peaks and valleys but not necessarily the same radius as others of said peaks and valleys;

measuring approximately equal distance from each said string line of constant radius toward and away from said view to establish the front and rear boundary lines of a plurality of adjoining lots;

measuring approximately equal distances along each said string line of constant radius to establish approximately equally spaced apart side boundary lines for said plurality of adjoining lots; and laying out substantially identical building envelopes on substantially all of said lots immediately adjacent corresponding ones of said side boundary lines to provide a line-of-sight to said view site.

14. The method of claim 13 wherein said development site is bounded in part by an undulating perimeter, and wherein said locating step is preceded by the steps of striking an imaginary arc of constant radius spaced inwardly from the boundary of each undulation of said undulating perimeter; and connecting each arc to form said undulating path of said string line.

15. The method of claim 13 wherein the topography of said development site is characterized by hills and canyons, and wherein said locating step is preceded by the steps of laying an imaginary flexible string upon a topographical plan view of said development site, and along topographical elevation lines having as nearly the same elevation as practicable to thereby define an undulating perimeter; striking an imaginary arc of constant radius spaced inwardly from the boundary of each undulation of said undulating perimeter; and connecting each arc to form said undulating path of said string line.

* * * * *